United States Patent [19]

Spindeler et al.

[11] Patent Number: 4,564,419

[45] Date of Patent: Jan. 14, 1986

[54] NOZZLE PLATE CONSTRUCTION FOR UNDERJET COKE OVENS

[75] Inventors: Heinz Spindeler; Folkard Wackerbarth; Gerd Halbherr, all of Bochum

[73] Assignee: Dr. C. Otto & Comp. G.m.b.H., Bochum, Fed. Rep. of Germany

[21] Appl. No.: 679,384

[22] Filed: Dec. 7, 1984

[30] Foreign Application Priority Data

Dec. 31, 1983 [DE] Fed. Rep. of Germany ..... 3347664

[51] Int. Cl.[4] ..... C10B 1/04

[52] U.S. Cl. ..... 202/123; 98/41.3; 110/230; 110/245; 202/124; 202/126; 202/270; 432/58

[58] Field of Search ..... 202/123, 124, 125, 126, 202/127, 138, 139, 141, 142, 270; 98/41.3, 41.1, 40.9; 432/58; 110/230, 245

[56] References Cited

U.S. PATENT DOCUMENTS 3,252,872 5/1966 Grumm ..... 202/141

*Primary Examiner*—Jay H. Woo
*Assistant Examiner*—Jennifer E. Cabaniss
*Attorney, Agent, or Firm*—Thomas H. Murray; Clifford A. Poff

[57] ABSTRACT

A nozzle plate construction for underjet coke ovens for distributing and metering combustion-supporting air supplied upwardly to regenerators through a sole flue extending parallel to the chamber axis. The sole flue is closed at the top by plate elements having apertures therein. In accordance with the invention, the various plate elements are in the form of troughs having plane base plates each formed with one longitudinal gap therein. Associated with each longitudinal gap is a metering element so mounted at its ends so as to be adjustable in its distance from the plane of the base plate. In this manner, the air flowing upwardly into the regenerator sections can be accurately controlled and uniformly distributed. At the same time, the nozzle plate construction of the invention is light in weight while being very stable and easy to assemble.

13 Claims, 12 Drawing Figures

NOZZLE PLATE CONSTRUCTION FOR UNDERJET COKE OVENS

BACKGROUND OF THE INVENTION

In underjet coke ovens, nozzle plate constructions are provided for distributing and metering combustion-supporting air supplied upwardly to the regenerators through a sole flue which extends parallel to the coke oven chamber axis. The sole flue is closed at its top by plate elements which are disposed in end-to-end relationship. The plate elements are usually supported by side ledges of the sole flue and are provided with apertures through which air can pass from the sole flue to the regenerators. Depending on the cross-sectional area of the apertures, the amount of combustion-supporting air supplied to the regenerators can be controlled; and in this respect the nozzle plate constructions act as valves.

One of the main requirements in coke oven heating is uniform metering and distribution of the combustion-supporting air with an accuracy that meets the requirements of combustion technology. In practice, there are considerable difficulties encountered in meeting these requirements. In an underjet oven, the combustion-supporting air which must be preheated flows from a sole flue below the regenerator into the voids of the regenerator bricks. To insure that the combustion-supporting air is distributed properly, plates of the type described above have been provided in the top part of the sole flue, the plates being formed with apertures of different sizes as a means of controlling air distribution. An arrangement of this type is disclosed, for example, in U.S. Pat. No. 3,252,872.

Plates formed with apertures of different sizes, however, have a number of unsatisfactory features. The main disadvantages are uneven and difficult distribution of the combustion-supporting air. The required quantity of air can be adjusted only by trial and error, a difficult, time-consuming and expensive procedure. Moreover, due to lack of seals, cross-flows occur between the various regenerator portions and may be responsible for uncontrolled interaction affecting air distribution in the various portions.

SUMMARY OF THE INVENTION

In accordance with the present invention, a new and improved nozzle plate construction is provided for underjet coke ovens which enables the air-flow orifices to be adjusted more readily and more accurately to suit requirements. The construction according to the invention is readily removable and replaceable and is capable of altering the setting of air-flow apertures, even during operation. The construction reduces unwanted cross-flows, is light in weight, and suitable for low-cost production.

Specifically, there is provided in accordance with the invention a nozzle plate construction characterized by the following features:

The various plate elements are in the form of a trough having a flat base plate formed with at least one longitudinal gap therein and low, longitudinally-extending side walls;

Associated with each longitudinal gap is a metering element mounted at its ends so as to be adjustable in its distance from the plane of the base plate;

The base plate elements correspond in their lengths approximately to the distance between two partitions of a coke oven regenerator; and The base plate elements are interconnected by means of cooperating coupling elements.

Advantageously, the longitudinal side walls of the individual base plate elements are formed by bent edge strips integral with the base plates themselves. This feature considerably strengthens the base plate elements and enables them to be made of relatively thin plate or sheet material.

The air-flow apertures can take the form of either a single central longitudinal gap in each plate element or can comprise two or more parallel longitudinal gaps in each plate element. The metering element associated with each longitudinal gap can be either a T-section, an angle section, or possibly a tube whose width is greater than the width of the longitudinal gap. The metering element can be moved toward or away from the gap to vary the effective cross-sectional area of the space through which the air flow. An angle plate having a horizontally-extending portion parallel to the base plate is secured to each end of the plate element; while a horizontal retaining plate is welded to the upright arm of the angle plate and is formed with a bore through which an adjusting screw extends for rotation, the threaded end of the adjusting screw engaging a tapped bore in an element secured to the metering element. In the case where the metering element is in the form of an angle section, the angle is suspended on the adjusting screws at its opposite ends such that its apex is near the center of a longitudinal gap in a plate element. With the use of two adjusting screws as described above, each individual metering element can be moved upwardly or downwardly such that the operative flow cross sections between the gap edges and the metering element can be adjusted. If the adjusting screws are adjusted such that the opposite ends of the metering element are at different heights, a variable flow cross-sectional area can be achieved along the length of the metering element.

The various plate elements forming the nozzle plate construction have lengths equal to the distance between two regenerator partitions. Depending upon oven length, a corresponding number of plate elements are introduced consecutively into the sole flue from both sides of the oven and progress toward the center thereof. The plate elements are interconnected by suspension couplings. In this manner, and should it be required to readjust the air-flow apertures, the plate elements can be removed from the sole flue readily and rapidly.

Additional seals below the regenerator partitions are provided to obviate cross-flows between the various regenerator portions. In one embodiment of the invention, the seals may take the form of thin-walled flexible steel tubes introduced between the angle plates and the underside of a partition, the tube diameter being greater than the width between the angle plates and the bottom edge of the partition. Because of the resulting slight deformation of the tube, a constantly resilient seal results between the nozzle plate construction and the bottom edge of each partition. Advantageously, felt rings are secured to the ends of the steel tube to improve sealing tightness between the tube ends and the sole flue side walls.

The plate elements are not interconnected beneath the regenerator partition at the center of the oven in order to permit the plate elements to be withdrawn from either end of the oven. In this zone, angular thin-walled resilient sealing elements are provided on the ends of adjacent plate elements. Felt strips are secured to those edges of the sealing elements which abut the sole flue side walls and/or regenerator partitions.

BRIEF DESCRIPTION OF THE DRAWINGS

The above and other objects and features of the invention will become apparent from the following detailed description taken in connection with the accompanying drawings which form a part of this specification, and in which.

DETAILED DESCRIPTION OF THE DRAWINGS

Figure 1:
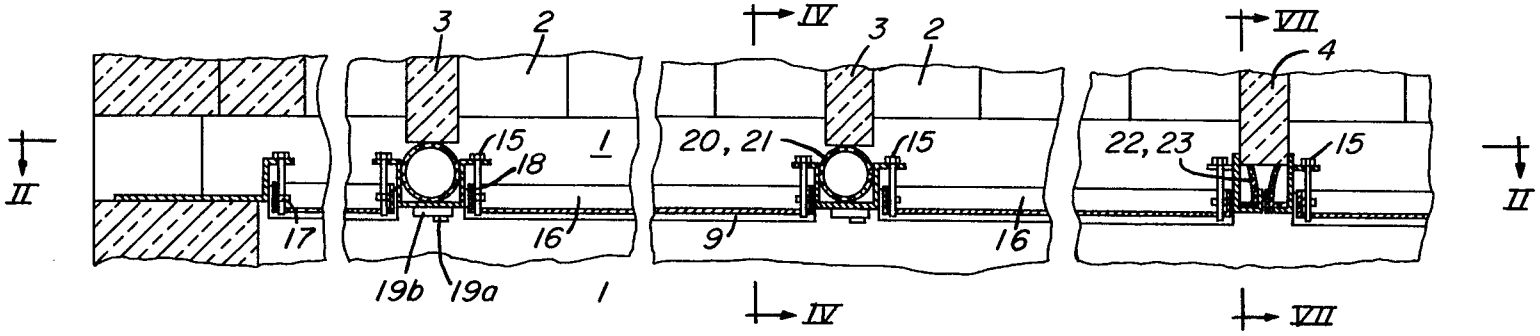
FIG. 1 is a vertical longitudinal section through a coke oven sole flue incorporating a nozzle plate construction according to the invention and taken substantially along line I—I of FIG. 2.
Figure 2:
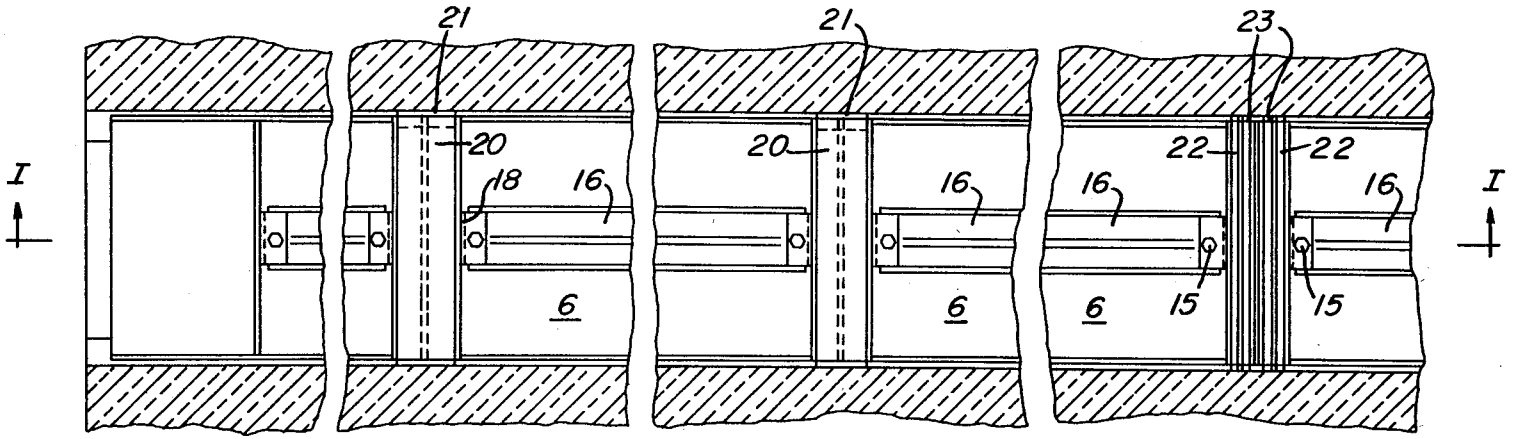
FIG. 2 is a horizontal longitudinal section taken through the sole flue substantially along line II—II of FIG. 1.
Figure 3:
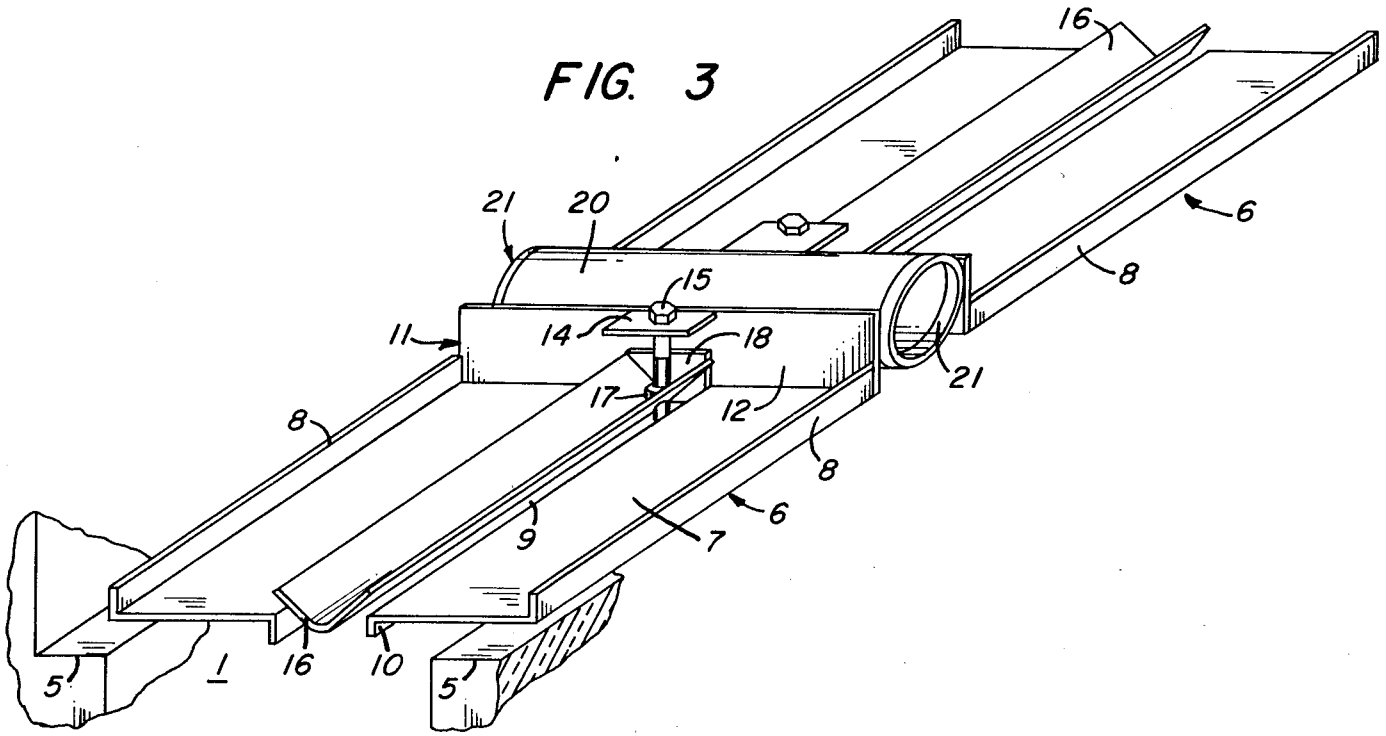
FIG. 3 is a perspective view of two interconnected plate elements of the nozzle plate construction of the invention.
Figure 4:
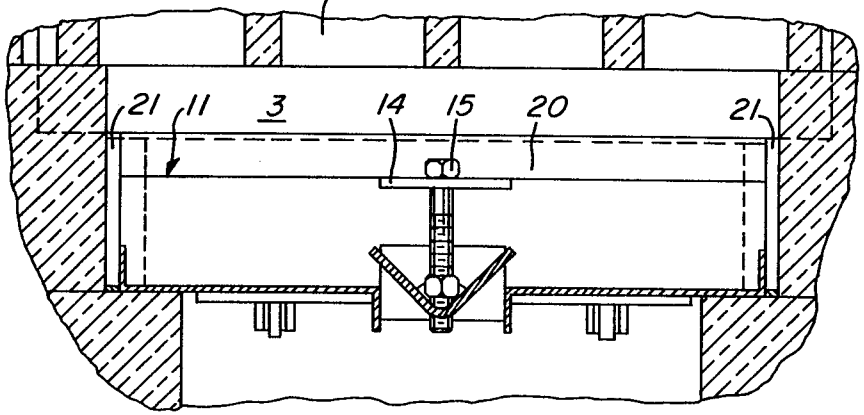
FIG. 4 is a vertical cross section taken through the sole flue along line IV—IV of FIG. 1.
Figure 7:
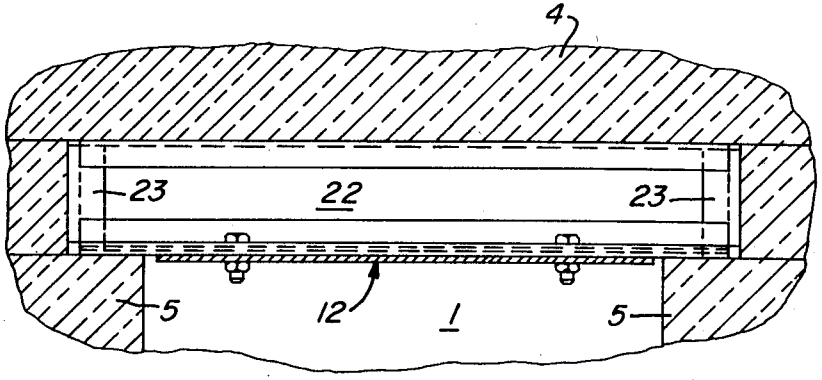
FIG. 7 is a vertical cross section taken through the sole flue along line VII—VII of FIGS. 1 and 6.

Referring now to the drawings, and particularly to FIG. 1, there is shown a coke oven sole flue 1. Above the sole flue 1 are the bricks 2 of a regenerator. (See also FIGS. 2 and 5.) Partitions 3 on opposite sides of the center of the oven separate regenerator portions in accordance with usual practice. Partition 4 is also a regenerator partition, but it is at the center of the oven, having partitions 3 on either side thereof. As shown in FIGS. 3, 4 and 7, the sole flue side walls have ledges 5 which support plate elements 6 of the nozzle plate construction.

Figure 5:
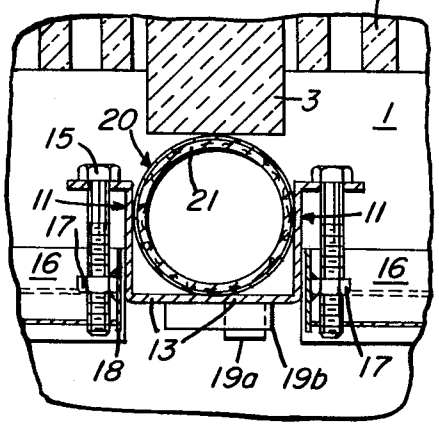
FIG. 5 is an enlarged end view of the tubular seals and associated supporting structure shown in FIGS. 1-3.

Each single plate element 6 is in the form of a trough having a flat base plate 7 (FIG. 3) and relatively low longitudinal side walls or edges 8 formed by bending edge strips of the base plate 7. As shown in FIG. 3, the edges 8 are preferably at right angles to the base plate 7. Intermediate the longitudinal side edges 8 of each base plate 7 is a central longitudinal gap 9 bounded by downwardly-bent metal flanges 10. At opposite ends of the plate elements 6, and secured thereto by welding or the like, are angle plates 11 (FIGS. 3 and 5) whose vertically-extending arms 12 form end closures for the trough formed by the plate element 6. Angle plates 11 also have horizontal arms 13 which project beyond the plate element 6 and, with the plate element in position in the coke oven, extend substantially to the center of a regenerator partition as shown in FIG. 5. In this regard, the ends of adjacent horizontal portions 13 are separated, face each other, and are interconnected by fastening means about to be described.

In the embodiment of FIGS. 1-4, a metering element is disposed within the longitudinal gap 9 and is in the form of an angle iron 16 which is closed at its opposite ends by a closure plate 18. Welded or otherwise securely fastened to the plate 18 are nuts 17 which receive the threaded ends of adjusting screws 15. The adjusting screws 15, as best shown in FIG. 4, pass through bores in horizontal plates 14 extending outwardly from the upper edge of the arms 12 of angle plates 11. As illustrated, the apex of the angle iron 16 extends toward the gap 9 and centrally thereof. The closure plates 18 are preferably rectangular in shape and have a width slightly less than that of the gap 9 so as to form guide elements for the angle irons 16 as they are adjusted upwardly or downwardly by the adjusting screws 15. By rotating the adjusting screws 15, the position of the angle irons 16 within the gaps 9 can be adjusted upwardly or downwardly. In this manner, the cross-sectional sizes of the opening in the gaps through which combustion-supporting air flows can be varied substantially steplessly. If the two adjusting screws 15 at opposite ends of a single angle iron 16 are turned in different amounts, the flow cross section of the combustion-supporting air can be adjusted such that it varies along the length of the gap 9 whereby the airflow along the sole flue can be adjusted to have increasing or decreasing intensity between two regenerator walls.

Figure 8:
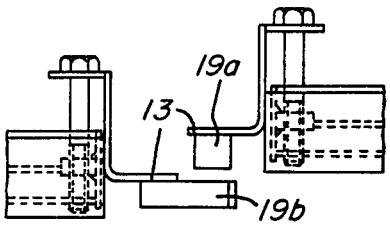
FIG. 8 is a side view of a typical suspension coupling utilized to interconnect plate elements of the nozzle plate construction of the invention.

The plate elements on opposite sides of the center partition 4 are interconnected so as to be capable of articulation with respect to each other. In this regard, cooperating coupling parts 19A and 19B (FIGS. 1, 5 and 8) are provided on the underside of adjacent angle plate arms 13. Known devices can be used for this purpose which are adapted to be interconnected by being inserted one into the other or pushed together as shown by way of example in the hook and eye connection of FIG. 8. As a result of this construction, all of the plate elements 6 on either side of the oven center partition 4 can be withdrawn in one pull from the sole flue 1 outside the oven and then reinserted in the same manner.

In order to provide sealing tightness and to obviate unwanted flows above the nozzle plate construction between adjacent regenerator portions, a thin-walled flexible steel or the like tube 20 is provided below the partitions 3 between two regenerator portions and is supported on the horizontal arms 13 of the angle plates 11 on adjacent plate elements 6. As shown, the diameter of each tube 20 is greater than the vertical clearance between the horizontal arms 13 and the underside of an associated partition 3. The diameter of the tube 20 is also greater than the internal clearance between the vertical arms 12 of the respective angle plates 11. The resulting slight deformation of the tube 20 results in a constant resilient seal between an associated partition 3 and the nozzle plate construction itself. As can be seen in FIG. 3, felt rings 21 are secured to the ends of each tube 20 to improve sealing tightness between the tube and the sole flue side walls.

Figure 6:
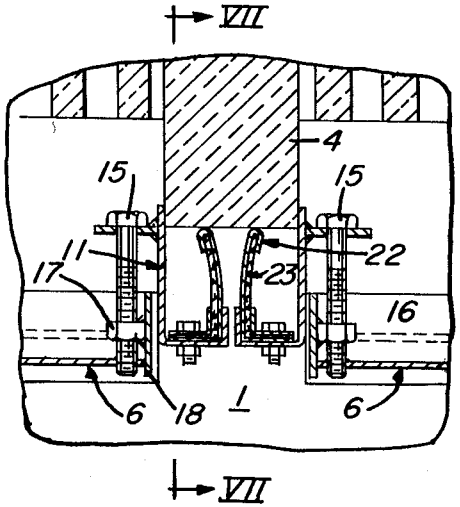
FIG. 6 is an enlarged end view of the seal beneath the partition at the center of the coke oven.

The seal below the partition 4 at the center of the coke oven is different (FIGS. 1 and 6). Here, angular thin-walled resilient sealing elements 22 made of special steel are secured to the tops of the horizontal arms 13 of the angle plates 11 by nuts. Their free edges bear resiliently on the underside of the partition 4 as shown in FIGS. 6 and 7. Felt strips 23 are secured to the ends of the metal sealing elements 22 adjacent the sole flue side walls (FIG. 7) to improve sealing tightness.

Figure 9:
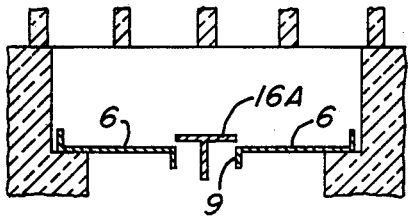
FIGS. 9-12 are vertical cross-sectional views through the sole flue showing variants in the cross-sectional shape of the metering element utilized in the nozzle plate construction of the invention.
Figure 10:
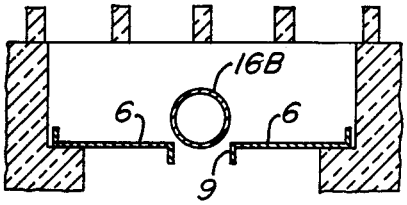
Figure 11:
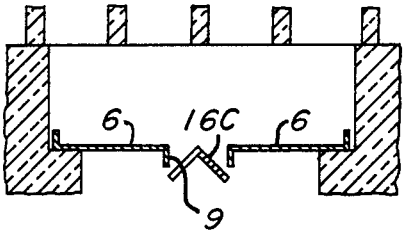
Figure 12:
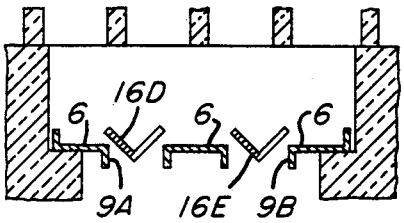

The metering element for controlling the flow cross-sectional area of the longitudinal gaps 9 in associated plate elements 6 can have cross-sectional shapes other than that of the angle iron 16 shown in FIGS. 3 and 5, for example. The cross-sectional shapes may be tees, half rounds or tubes. FIGS. 9 and 10, for example, are diagrammatic views of a T-section metering element 16A and a tubular metering element 16B, respectively. As shown in FIG. 11, the metering element 16C can be disposed on the underside of the plate elements 6 instead of on the top as in the embodiment of FIGS. 3 and 5. Furthermore, stationary deflecting plates, not shown, can be provided adjacent the metering elements to produce a particular flow pattern of the combustion-supporting air. FIG. 12 illustrates how a single plate element 6 can be formed with two or more parallel longitudinal gaps 9A and 9B, each provided with an associated metering element 16D and 16E. In the embodiment shown in FIG. 12, the entering air is divided into discrete partial flows and the metering effect is further enhanced.

A nozzle plate construction of the type described herein is light in weight yet very stable and easy to assemble. The releasable steel tubes 20 between two consecutive plate elements seal the entire void between the bearing surfaces on arms 13 and the partition wall 3 bottom edge. The plate elements can shift laterally without any impairment in the service ability of the steel tubes with the felt inserts at their ends. Furthermore, flexible steel tubes do not impede insertion and removal of the plate elements.

Although the invention has been shown in connection with certain specific embodiments, it will be readily apparent to those skilled in the art that various changes in form and arrangement of parts may be made to suit requirements without departing from the spirit and scope of the invention.

We claim as our invention:

1. A nozzle plate construction for underjet coke ovens for distributing and metering combustion-supporting air supplied upwardly to regenerators through a sole flue which extends parallel to a coke oven chamber axis, the sole flue being closed at its top by plate elements which are formed with apertures therein and disposed releasably in end-to-end relationship, each of said plate elements being in the form of a trough having a plane base plate and low longitudinal side walls, at least one longitudinal gap formed in the base plate, and a metering element for each longitudinal gap mounted at its ends so as to be adjustable in its distance from the plane of said base plate.

2. The nozzle plate construction of claim 1 wherein said plate elements correspond in their lengths approximately to the distance between two partitions of a regenerator portion of said coke oven.

3. The nozzle plate construction of claim 1 including cooperating coupling elements provided at the plate element ends for interconnecting adjacent plate elements.

4. The nozzle plate construction of claim 1 wherein said low longitudinal walls of the plate elements are formed by bending edge strips of the base plate at an angle of approximately 90° with respect to the plane of the base plate.

5. The nozzle plate construction of claim 1 wherein each base plate has a plurality of longitudinal gaps therein and a plurality of metering elements each for a longitudinal gap.

6. The nozzle plate construction of claim 1 wherein said longitudinal gap is bounded by downwardly-bent edge strips on the base plate.

7. The nozzle plate construction of claim 1 wherein said metering element has a cross-sectional configuration selected from the group consisting of a T-cross section, an angle cross section and a tubular cross section, the width of the metering element with respect to the plane of the base plate being greater than the width of said longitudinal gap.

8. The nozzle plate construction of claim 1 including angle plates secured to opposite ends of said plate elements, each angle plate having a vertical arm and an outwardly-extending horizontal arm, and cooperating coupling parts secured to the undersides of the horizontal arms of adjacent plate elements.

9. The nozzle plate construction of claim 8 including a horizontal plate secured to the vertical arm of each angle plate and extending parallel to the plane of the base plate, a bore in each horizontal plate, an adjusting screw extending through said bore, and threaded means at an end of a metering element for engaging threads on said adjusting screw whereby the height of the metering element with respect to a gap in said base plate can be varied by rotating said adjusting screw.

10. The nozzle plate construction of claim 9 wherein the metering element comprises an angle section suspended on said adjusting screw such that the apex of said metering element is near the longitudinal gap in an associated base plate.

11. The nozzle plate construction of claim 8 including a thin-walled flexible steel tube located between adjacent horizontal arms of two facing angle plates and the underside of a coke oven regenerator partition, the tube diameter being greater than the width between the vertical arms of said angle plates and greater than the vertical clearance between the horizontal arms of the angle plates and the bottom edge of the regenerator partition.

12. The nozzle plate construction of claim 11 including felt rings secured to the ends of the thin-walled flexible tube to provide sealing tightness between the tube ends and the side walls of the coke oven sole flue.

13. The nozzle plate construction of claim 8 characterized in that, below a regenerator partition at the center of the oven are angular thin-walled resilient sealing elements mounted on adjacent horizontal arms of facing angle plates, and felt strips secured to those edges of the sealing elements which are adjacent to the sole flue side walls.

* * * * *